United States Patent [19]

Gainey

[11] Patent Number: 4,572,559

[45] Date of Patent: Feb. 25, 1986

[54] SCOOP FOR GATHERING LEAVES, GRASS, DEBRIS AND THE LIKE

[75] Inventor: John M. Gainey, Belle Chasse, La.

[73] Assignee: Bobby C. Gainey, Belle Chasse, La. ; a part interest

[21] Appl. No.: 608,976

[22] Filed: May 10, 1984

[51] Int. Cl.[4] ..... B65B 67/12; A01K 23/00

[52] U.S. Cl. ..... 294/1.1; 294/55

[58] Field of Search ..... 294/1 R, 55, 1 B, 1 BA; 15/104.8, 257.1; 141/108, 109, 313, 314, 341, 391; 248/99, 101

[56] References Cited

U.S. PATENT DOCUMENTS

| | | | |
|---|---|---|---|
| 112,727 | 3/1871 | Lum | 248/99 |
| 544,585 | 8/1895 | Mayo | 248/99 |
| 571,513 | 11/1896 | Davidson | 248/99 |
| 791,472 | 6/1905 | Kaiser | 294/55 |
| 970,396 | 10/1910 | Sapp et al. | 10/473 |
| 1,128,183 | 2/1915 | Pitrie | 294/55 |
| 3,754,785 | 8/1973 | Anderson | 294/19 R |
| 3,937,509 | 2/1976 | Hufnagel | 294/1 BA |
| 4,312,531 | 1/1982 | Cross | 294/55 |
| 4,470,627 | 9/1984 | Carroll et al. | 294/55 |

*Primary Examiner*—James B. Marbert

*Attorney, Agent, or Firm*—Pravel, Gambrell, Hewitt & Kimball

[57] ABSTRACT

A scoop for gathering leaves, cut grass, or debris in disposable bags provides a walled scoop having an interior bore which communicates with two open end portions. One of the end portions is used to receive leaves such as by raking, for example, while the other end portion attaches to a flexible, disposable bag such as a plastic bag or the like. The scoop has a generally flat lower surface which is adapted to contact the ground as during the transfer of leaves, cut grass, and/or debris into the scoop. A scoop handle is affixed to the upper surface of the scoop so that pressure can be applied to the scoop during loading. A bracket is positioned on the upper surface of the scoop adjacent the handle and extending toward the open end portion of the scoop which is receptive of the plastic disposable bag. A flexible strap having end portions with hooks can encircle the scoop after a plastic bag has been assembled about one open end of the scoop. The flexible strap has hooks on its end portions. A releasable connection is formed between the hooks on the end portions of the flexible strap and the bracket. The bracket provides an opening which attaches to one of the hooks and a recess which attaches to the other end of the strap at one of the hooks. Thus the strap encircles the scoop so that when connected to the bracket it can secure a disposable bag to be filled.

8 Claims, 8 Drawing Figures

SCOOP FOR GATHERING LEAVES, GRASS, DEBRIS AND THE LIKE

BACKGROUND OF THE INVENTION

1. Technical Field

The present invention relates to devices which aid in the filling of bags with leaves, grass and debris. More particularly, the present invention relates to an improved loading scoop which can be attached to a bag to be loaded, wherein the scoop includes an improved bag securing attachment positioned next to the handle on the scoop.

2. Background Art

In the cleanup of lawn and garden areas, it is common to employ hand implements such as rakes, shovels, and the like to assemble the debris into spaced apart piles which are later loaded.

There are a number of commercially-available plastic bags which are simply folded into cardboard containers in large numbers. The bags are usually of a flexible plastic film material and are sealed at one end and opened at the other end. These bags are generally disposable and are discarded once filled with yard material to be gathered such as leaves, cut grass, debris and the like.

The disposable plastic bags are relatively light and are difficult to fill by a single user. It is to this problem that the present invention is directed. A number of devices have been patented which relate to scoops, buckets, or other bag filling devices. For example, the following patents include various scoops and aids to the filling of bags.

U.S. Pat. No. 4,312,531 issued on Jan. 26, 1982, to Richard Cross and entitled "Filling Aid for Plastic Trash Bags and the Like." This patent discloses a filling aid selectively positionable within a can-received flexible bag for a stabilization and protection of the bag and a guiding of debris and the like into the bag. The aid includes an elongated tubular split sleeve having open inner and outer ends and being of a resiliently flexible nature for a selective varying of the circumferential size thereof. The outer end of the sleeve includes an outwardly curled flange engageable over a can rim for the clamping of a bag thereto. An outwardly flaring scoop extends longitudinally from the flanged end of the sleeve, tapering from engagement with the periphery of the sleeve about approximately one half the circumference thereof, to a straight outer edge of a length greater than the normal diameter of the sleeve. This device is unlike the present invention in that it contemplates a rigid outer container and an outer flanged scoop to support the bag.

U.S. Pat. No. 3,754,785 entitled "Portable Bag Holder" issued on Aug. 23, 1973 to John Anderson. This patent shows a portable bag holder for detachably mounting a flexible garbage bag thereon comprising a handle, the provision of spaced supports for the mouth of the bag, devices for tensioning the mouth of the bag about said supports and a lip located to extend from the inside to the outside of the bag mount for facilitating loading of refuse into the bag directly off the ground. The device does not use the improved flexible strap and attachment bracket of the present invention but rather a complicated double clamp arrangement which would be cumbersome to use and expensive to manufacture.

U.S. Pat. No. 1,128,183 issued in 1915 and is entitled "Device for Handling and Bagging Grain." This patent shows a bagging device comprising a tubular scoop having projecting handles, a flexible duct connected with the discharge end of the scoop, the duct being tapered in the direction of its discharge end, a tapered bag supporting band having its small end connected with the small end of the duct, and a hoop externally engaging the tapering bag supporting band, the hoop being of smaller diameter than the large end of the band. The device does not show the improved connection of the present invention which is formed between the scoop and bag being filled.

U.S. Pat. No. 970,398 issued in 1910 and entitled "Bag Holder" discloses a bag frame formed of uprights, a plurality of expansible hoops secured thereto, each of the hoops being divided at one point for making the frame resilient, and means for holding a bag upon the frame. Unlike the present invention, this device uses drawstrings as part of the bag to secure the bag to the scoop.

U.S. Pat. No. 791,472 issued in 1905 to Ernst Kaiser shows a bag-filling device comprising a cylindrical tubular member having ends at right angles to the sides thereof, the member being of uniform size throughout, and a flat spring-clip attached on the exterior of the member near one end with its free end extending toward the other end, the clip having an offset intermediate its ends to receive the hem of the bag. The device is unlike the present invention because it does not fully support the bag opening all around the scoop opening but rather only supports the bag at spaced clips on the scoop.

U.S. Pat. No. 544,585 entitled "Sack Holder" issued in 1895 to A. Mayo. This patent shows an improved sack holder comprising a funnel-like body having at the lower outer edges hooks to support the sack, its ends being flared outward, the top of the front portion being disposed parallel with the bottom, the tops of the ends curving upward and rearward, the rear wall of the body being extended upward to form a shield or guide, the upper edges of which merge with the upper edges of the ends, the extension having apertures near the top, and a projecting handle member formed on the rear face of the body at a point beneath the aforesaid apertures. This device is similar to Kaiser, U.S. Pat. No. 791,472, in that it fails to support the bag all around the scoop opening, but rather uses spaced apart hooks. The device will not support a bag manufactured of plastic because the hooks would tear the bag.

U.S. Pat. No. 571,513 shows a bag-filler comprising the combination of a cylindrical tapering body having a flattened side at the large end, the body being of substantially the same length on the upper side as on the lower side, a blade secured to the flattened side and projecting slightly beyond the edges of the body, and handles at opposite ends of the body. This device does not show the improved connection between the bag and the scoop of the present invention but rather relies upon the hand of the user to hold the bag on the scoop.

U.S. Pat. No. 112,727 issued to W. F. Lum in 1871 shows a bag filler and holder comprising a shovel having handles in combination with a flexible tube or slack bag and holder having hooks thereon. The Lum device contemplates an open ended sack as a permanent part of the scoop such that grain passes through it.

GENERAL DISCUSSION OF THE PRESENT INVENTION

The present invention solves these prior art problems and shortcomings in a simple, straightforward and easy manner by providing a lawn scoop for gathering leaves, cut grass, or debris in disposable bags with a walled scoop having an interior bore which communicates with two open end portions. One of the end portions is used to receive leaves such as by raking, for example, while the other end portion attaches to a flexible, disposable bag such as a plastic bag or the like. The scoop has a generally flat lower surface which is adapted to contact the ground as during the transfer of leaves, cut grass, and/or debris into the scoop. A scoop handle is affixed to the upper surface of the scoop so that pressure can be applied to the scoop during loading. A bracket is positioned on the upper surface of the scoop adjacent the handle and extending toward the open end portion of the scoop which is receptive of the plastic disposable bag. A flexible strap having end portions with hooks can encircle the scoop after a plastic bag has been assembled about one open end of the scoop. The flexible strap has hooks on its end portions. A releasable connection is formed between the hooks on the end portions of the flexible strap and the bracket. The bracket provides an opening which attaches to one of the hooks and a recess which attaches to the other end of the strap at one of the hooks. Thus the strap encircles the scoop so that when connected to the bracket it can secure a disposable bag to be filled.

BRIEF DESCRIPTION OF THE DRAWINGS

For a further understanding of the nature and objects of the present invention, reference should be had to the following detailed description, taken in conjunction with the accompanying drawings in which the parts are given like reference numerals and wherein.

DETAILED DESCRIPTION OF THE PREFERRED EMBODIMENT

Figure 1:
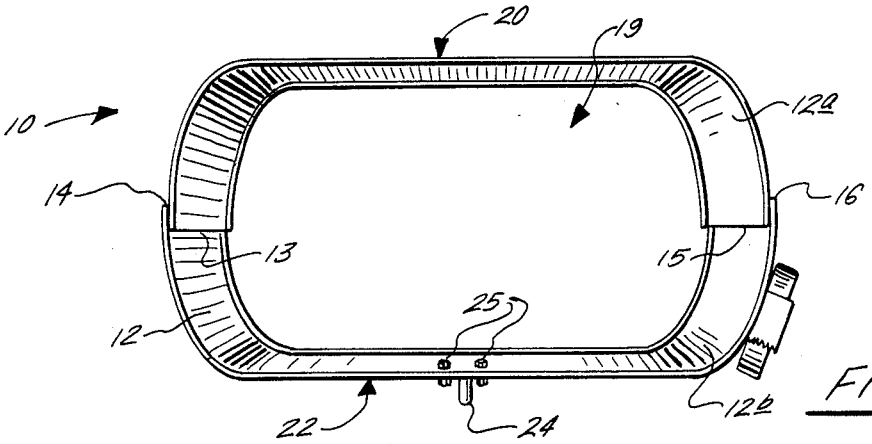
FIG. 1 is an end view of the preferred embodiment of the apparatus of the present invention.
Figure 2:
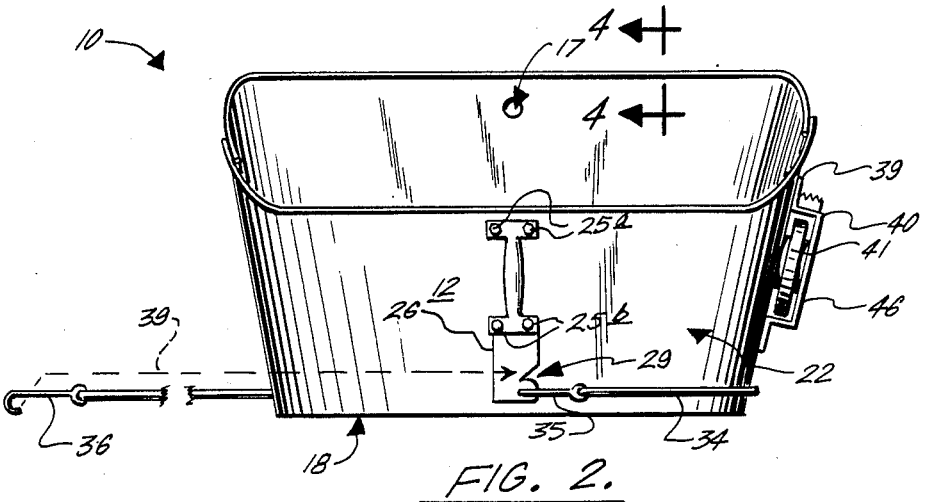
FIG. 2 is a top view of the preferred embodiment of the apparatus of the present invention.
Figure 3:
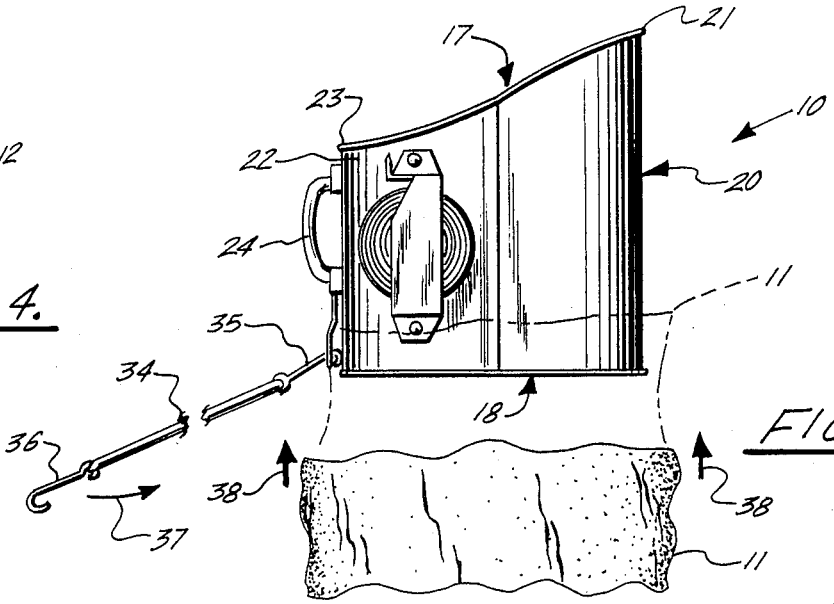
FIG. 3 is an end view of the preferred embodiment of the apparatus of the present invention.
Figure 5:
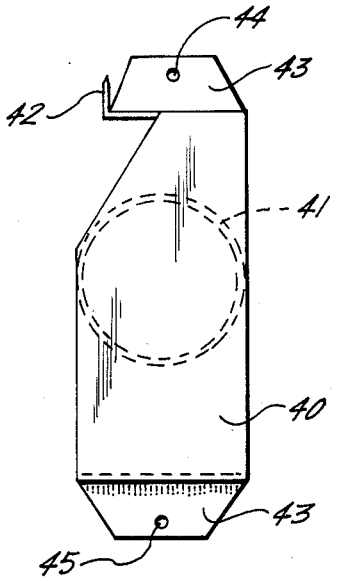
FIG. 5 is a fragmentary view of the preferred embodiment of the apparatus of the present invention showing the tape dispensing portion thereof.
Figure 6:
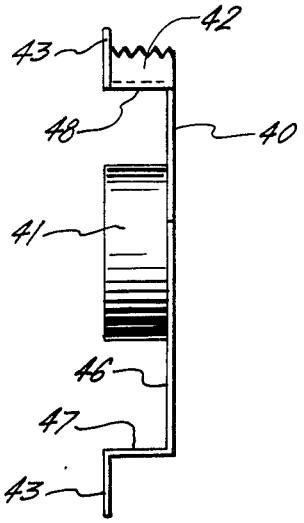
FIG. 6 is a side view of the tape dispensing bracket of FIG. 5.

FIGS. 1–3 best show the preferred embodiment of the apparatus of the present invention designated generally by the numeral 10.

Looking at FIG. 1, there can be seen an end view of bagging scoop 10 which is adapted to connect with a flexible bag 11 such as a plastic bag. Such bags 11 are commercially available and well-known in the art.

Figure 4:
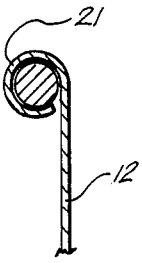
FIG. 4 is a sectional view taken along lines 4—4 of FIG. 2.

Bagging scoop 10 provides an endless wall 12 formed of a pair of wall sections 12*a*, 12*b* which overlap with the end portions 13, 15 of section 12*a* overlapping the end portions 14, 16 of section 12*b*. The scoop 10 provides a first open end portion 17 and a second open end portion 18 which communicate with and open through bore 19. The bottom portion 20 of scoop 10 is relatively flat and thus is adapted to engage the ground as, for example, during raking of leaves, grass and/or other debris into the scoop through intake opening 17 so that any material loaded into the scoop through opening 17 can then be added to bag 11 by exiting the scoop through discharge opening 18. A lower lip 21 of intake opening 17 protrudes forwardly of the uppermost lip 23 of intake opening 17 thus producing a bevel as best seen in FIG. 4.

Figure 7:
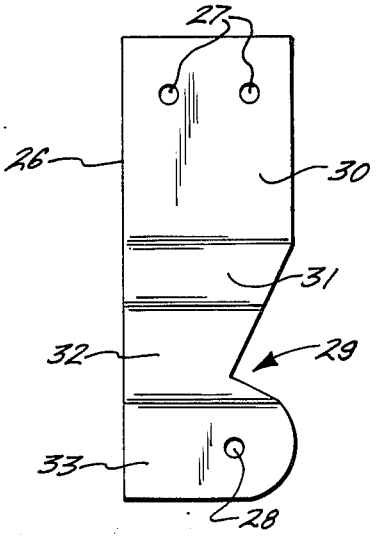
FIG. 7 is a top view of the bracket portion of the preferred embodiment of the apparatus of the present invention.
Figure 8:
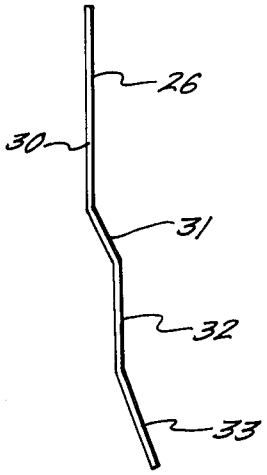
FIG. 8 is a side view of the bracket portion of the preferred embodiment of the apparatus of the present invention.

The upper surface 22 of scoop 10 is provided with handle 24 which is bolted, for example, by bolted connections 25*a*, 25*b*. Handle 24 is preferably aligned with bore 19 as is best seen in FIG. 2. Bracket 26 is affixed to the upper surface 22 of scoop 10 by bolted connection 25*b*. It should be understood that it is preferred that the bolted connection 25*b* is a common fastener for attaching one end portion of handle 24 and bracket 26 to the top 22 of scoop 10. In that regard, FIGS. 7 and 8 illustrate bracket 26 and its configuration. Bracket 26 provides a pair of spaced apart opening 27 at one end portion thereof which are receptive of bolted connections 25*b*. The opposite end portion of bracket 26 includes one opening 28 which is adapted to connect with one of the hooks 35, 36 of flexible rubber strap 34. A recess 29 is receptive of the other hook 36 of strap 34. The arrow 39 in FIG. 2 illustrates assembly of flexible strap 34 to bracket 26. Note that one end portion of strap 34 provides hook 35 which affixes to the opening 28 of bracket 26. The opposite end portion of strap 34 provides hook 36 which attaches to recess 29 of bracket 26. The user simply encircles strap 34 about the discharge 18 end portion of scoop 10. Preferably the circumference of scoop 10 at opening 18 would be slightly larger than the overall length of strap 34 so that the strap 34 would be stretched when encircles about scoop 10 adjacent opening 18 and hooks 35, 36 attached to bracket 26 as aforementioned.

In FIG. 8 it can be seen that bracket 26 comprises a plurality of sections 30–33 which are integrally connected. This configuration elevates the portion 33 and 32 above the upper surface 22 of scoop 10 so that hook 36 can attach to recess 29 and so that hook 35 can attach to opening 28. Arrow 37 in FIG. 3 illustrates the assembly of strap 34 about the scoop 10 adjacent opening 18. Arrows 38 in FIG. 3 illustrate the assembly of a plastic disposable bag 11 to the open end 18 of scoop 10.

A tape dispenser 40 is attached at 39 to scoop 10. Dispenser 40 includes a pair of spaced apart flanges 43 each provided with an opening 44, 45 for receiving a rivet, bolted connection or the like therethrough. Corresponding openings not shown would be provided on scoop 10 so that the opening on the scoop and the opening on the bracket would align upon assembly. Dispenser 40 would carry a reel of tape 41 that could be used to seal the opening of a particular disposable bag 11 once it were filled with scoop 10. In that regard, a serrated cutting edge 42 would be used to cut lengths of tape material from reel 41. Flanges 43 attach to spacers 47, 48 which support plates 46 in a spaced position from the surface of wall 12 as best seen in FIG. 2.

Scoop 10 would be manufactured of any suitable, structural material such as galvanized steel, plastic or the like. Similarly, handle 24, bracket 26, tape dispenser 40 and hooks 35, 36 would all be of a structurally integral material such as steel, cast iron, fiberglass, plastic or the like. Flexible strap 34 would preferably be rubber or any other suitable, flexible, stretchable material. As an alternative, strap 34 could be an elongated coil spring, for example.

The apparatus could be equipped with an appropriate hole for hanging on a wall.

Because many varying and different embodiments may be made within the scope of the inventive concept herein taught, and because many modifications may be made in the embodiment of the law, it is to be understood that the details herein are to be interpreted as illustrative and not in a limiting sense.

What is claimed as invention is:

1. A scoop for gathering leaves, cut grass, or debris in disposable bags:

a. a walled scoop having an interior bore which communicates with two open end portions, the scoop having a generally flat lower surface extending substantially between the open end portions which is adapted to contact the ground as during the transfer of leaves, cut grass or debris into the scoop;

b. a scoop handle affixed to the upper surface of the scoop generally opposite the flat portion so that pressure can be applied to the handle to force the flat bottom against an underlying terrain;

c. a bracket positioned on the upper surface of the scoop adjacent the handle, and extending toward one of the open end portions of the scoop;

d. flexible strap having hooks on its end portions; and e. releasable connection means associated with the bracket for forming a connection with the bracket when the strap encircles the scoop so that the strap when connected to the bracket can secure a disposable bag to be filled to one end portion of the scoop.

2. The scoop of claim 1, wherein the strap is a rubber strap having a hook on each end portion and the releasable connection means includes at least one recess on the bracket receptive of one of the hooks.

3. The scoop of claim 1, wherein the handle and the bracket are connected together.

4. The scoop of claim 3, wherein the handle and the bracket are elongated and are generally aligned with the bore.

5. The scoop of claim 2, wherein the releasable connection means includes at least one opening in the bracket.

6. The scoop of claim 1, wherein the handle and bracket are affixed to the scoop with a common fastener and the bracket and handle each extend away from the common fastener toward the respective open end portions of the scoop.

7. The scoop of claim 1 further comprising a tape dispensig carriage mounted on the exterior surface of the scoop.

8. The scoop of claim 5 wherein the opening and recess are positioned adjacent one another so that the end portions of the strap are correspondingly positioned adjacent one another when the strap ends are attached to the bracket.

* * * * *